US011920103B2

(12) United States Patent
Bongardt et al.

(10) Patent No.: US 11,920,103 B2
(45) Date of Patent: Mar. 5, 2024

(54) MINERAL-OIL-FREE LUBRICANT AND METHOD FOR PRODUCING A MINERAL-OIL-FREE LUBRICANT

(71) Applicant: KAJO GMBH, Anrochte (DE)

(72) Inventors: Frank Bongardt, Meerbusch (DE); Markus John, Anrochte (DE)

(73) Assignee: KAJO GMBH, Anrochte (DE)

( * ) Notice: Subject to any disclaimer, the term of this patent is extended or adjusted under 35 U.S.C. 154(b) by 0 days.

(21) Appl. No.: 17/417,673

(22) PCT Filed: Dec. 19, 2019

(86) PCT No.: PCT/EP2019/086264

§ 371 (c)(1),
(2) Date: Jun. 23, 2021

(87) PCT Pub. No.: WO2020/136075

PCT Pub. Date: Jul. 2, 2020

(65) Prior Publication Data

US 2022/0056365 A1 Feb. 24, 2022

(30) Foreign Application Priority Data

Dec. 24, 2018 (DE) ..... 10 2018 133 586.5

(51) Int. Cl.
*C10M 159/24* (2006.01)
*C10M 105/34* (2006.01)
(Continued)

(52) U.S. Cl.
CPC ..... *C10M 159/24* (2013.01); *C10M 105/34* (2013.01); *C10M 105/36* (2013.01);
(Continued)

(58) Field of Classification Search
CPC ..... C10M 159/24; C10M 105/34; C10M 105/36; C10M 105/38; C10M 125/10; C10M 135/10; C10M 2201/062; C10M 2207/2815; C10M 2207/2825; C10M 2219/046; C10N 2030/40; C10N 2030/64; C10N 2030/52; C10N 2010/04; C10N 2020/02; C10N 2050/10; C10N 2070/00
See application file for complete search history.

(56) References Cited

FOREIGN PATENT DOCUMENTS

| | | | |
|---|---|---|---|
| CN | 104010972 | * | 8/2017 |
| IL | 49226 | * | 3/1980 |

* cited by examiner

*Primary Examiner* — Cephia D Toomer
(74) *Attorney, Agent, or Firm* — David R. Stevens; Stevens Law Group

(57) ABSTRACT

A method for producing a lubricant in producing an overbased calcium sulfonate, which is converted from the vaterite form into the calcite form and, finally, a calcium sulfonate grease is produced by heating the mixture. A lubricant may comprise at least one ester composition, calcium carbonate and at least one overbased alkylbenzene sulfonate. The basicity of the mixture is limited during the preparation of the overbased calcium sulfonate to a TBN of at most 550 mg KOH/g and during the conversion of the calcium sulfonate to a TBN of at most 450 mg KOH/g. Both the calcium sulfonate and the grease containing said calcium sulfonate may be produced exclusively on an ester basis, so that the end product does not contain any mineral oil and is therefore easily and completely biodegradable.

3 Claims, 3 Drawing Sheets

(51) Int. Cl.

| | |
|---|---|
| ***C10M 105/36*** | (2006.01) |
| ***C10M 105/38*** | (2006.01) |
| ***C10M 125/10*** | (2006.01) |
| ***C10M 135/10*** | (2006.01) |
| *C10N 10/04* | (2006.01) |
| *C10N 20/02* | (2006.01) |
| *C10N 30/00* | (2006.01) |
| *C10N 50/10* | (2006.01) |
| *C10N 70/00* | (2006.01) |

(52) U.S. Cl.

CPC ..... *C10M 105/38* (2013.01); *C10M 125/10* (2013.01); *C10M 135/10* (2013.01); *C10M 2201/062* (2013.01); *C10M 2207/2815* (2013.01); *C10M 2207/2825* (2013.01); *C10M 2219/046* (2013.01); *C10N 2010/04* (2013.01); *C10N 2020/02* (2013.01); *C10N 2030/40* (2020.05); *C10N 2030/52* (2020.05); *C10N 2030/64* (2020.05); *C10N 2050/10* (2013.01); *C10N 2070/00* (2013.01)

MINERAL-OIL-FREE LUBRICANT AND METHOD FOR PRODUCING A MINERAL-OIL-FREE LUBRICANT

BACKGROUND TO THE INVENTION

The invention relates to a method for producing a lubricant in which at first an overbased calcium sulfonate is produced or provided, this is then converted from the vaterite form into the calcite form and, finally, a calcium sulfonate grease is produced by heating the mixture. The invention further relates to a lubricant produced according to this method and to a lubricant comprising at least one ester composition, calcium carbonate and at least one overbased alkylbenzene sulfonate.

PRIOR ART

Lubricating agents or lubricants are used for the reduction of friction and wear, for dampening vibrations, for sealing and as anti-corrosion protection for tools, machines, engines and motor vehicles, aircraft, ships and parts thereof. A distinction is made in this case between liquid (lubricant oils), paste-like (lubricant greases) and solid (solid lubricants such as graphite, for example) lubricants. Lubricating greases are usually composed of a lubricating oil, a thickener and auxiliary and additional substances (additives). Lubricating greases usually contain approx. 80% lubricating oil, 5-10% thickener and 10-15% additives. Mineral oils, natural or synthetic ester oils, polyalphaolefins or silicon oils, for example, can be used as lubricating oils in this case. Synthetic ester oils include monocarboxylic acid esters, dicarboxylic acid esters, polyol esters and complex esters, for example. Apart from different soaps or inorganic substances (e.g. bentonite), calcium sulfonates are frequently used as thickeners and these also have a corrosion-inhibiting effect, in addition to their thickening action in the grease on account of their alkaline properties.

Calcium sulfonate greases which are currently available on the market are based exclusively on mineral oils or synthetic base oils such as polyalphaolefins (PAO). In this case, mineral oils and PAO account for up to 80% of the grease. The core components for producing a calcium sulfonate grease are the so-called overbased calcium sulfonates which are represented by the reaction of alkylbenzene sulfonic acids with calcium hydroxide and calcium oxide through the introduction of carbon dioxide in a mineral carrier oil. The overbased calcium sulfonates which are commercially available usually contain more than 50% mineral oil. It is not possible for quickly biodegradable calcium sulfonate greases to be produced using these constituents. Since a complete dispersal of calcium sulfonates is not usually completely achieved in mineral oils or PAO, solubilizers such as water, organic solvents and acids are added which then have to be removed again following production. Filtration is also often necessary to remove non-dispersed solid particles.

"Biodegradability" is understood to mean the decomposition of a lubricant into inorganic substances such as water, salts, carbon dioxide and biomass with the help of microorganisms. According to the current state of the art, the complete biodegradability of lubricants is determined exclusively by the OECD-301-test methods which are based on $CO_2$ production. The biodegradability is determined at the end of a "10-day test window" and after a 28-day test duration. If the lubricant has achieved the required degree of degradation of at least 60% at the end of the 10-day window and also after 28 days' incubation, it is classified as "readily biodegradable" and can be awarded the EU Ecolabel (EEL), for example.

WO 2004/106474 A1 describes lubricants with improved biodegradability which are based on a biodegradable oil such as, for example, a polyol ester (C5-C8) or a polyalkylene glycol, a calcium sulfonate-based thickener and a naturally occurring phospholipid. In this case, however, a mixture of mineral oil-based overbased magnesium and calcium sulfonates is used as the thickener. Due to the not insubstantial mineral oil content, complete biodegradability in accordance with OECD-301 cannot therefore be achieved for the lubricant described in WO 2004/106474 A1.

DESCRIPTION OF THE INVENTION

It is an object of the invention to provide a method for producing a lubricant which does not require the use or addition of mineral oil and to create a lubricant that is completely biodegradable.

The problem is solved according to the invention by a method for producing a solvent which comprises the following steps:

a) preparation of an overbased calcium sulfonate which comprises the following steps:
   - dissolving at least one mono-, di- or tri-alkylbenzene sulfonic acid, wherein at least one alkyl group is a (C3-C30)-alkyl group, in at least one ester composition, wherein the ester composition comprises at least one ester;
   - admixing calcium hydroxide and calcium oxide;
   - heating the mixture to a temperature in the range from 30° C. to 90° C. and introducing carbon dioxide into the mixture, wherein the mixture is adjusted to a base number (TBN) of at most 550 mg KOH/g;

b) conversion of the overbased calcium sulfonate from the vaterite form into the calcite form which comprises the following steps:
   - adjusting the mixture to a water content in the range of 2% by wt. to 20% by wt.;
   - heating the mixture to a temperature in the range of 80° C. to 105° C., wherein the mixture is adjusted to a base number of no more than 450 mg KOH/g; and c) production of a calcium sulfonate grease by heating the mixture to a temperature in the range of 90° C. to 200° C.

The method according to the invention is particularly characterized in that both the calcium sulfonate and grease containing said calcium sulfonate are produced exclusively on an ester basis, so that the end product contains no mineral oil and is therefore easily and completely biodegradable. The lubricant according to the invention achieves the required 60% degree of degradation at the end of the so-called 10-day window and also after 28 days and thereby satisfies the requirements of the OECD-301 test method. In addition, the replacement of mineral oil with organic or synthetic esters means that the addition of solubilizers can be dispensed with, so that these no longer have to be removed in a costly manner at the end of the production process. The method according to the invention further ensures that the overbased calcium sulfonates in the reaction mixture are completely dispersed, so that filtration can also be dispensed with at the end of the process.

According to the invention, the conditions for producing the lubricant are selected in such a manner that the ester composition is not decomposed under these conditions. To this end, the base number (TBN=Total Base Number), which is a measure of the basicity of the reaction mixture, i.e. the ability of the substances contained in the mixture to neutralize acid, is determined during the process. The unit [mg KOH/g] in this case relates to the basicity of potassium hydroxide (KOH). According to the invention, the basicity of the mixture in step a) is limited to a TBN of no more than 550 mg KOH/g and in step b) to a TBN of no more than 450 mg KOH/g. Monitoring and adjusting or limiting the basicity of the mixture advantageously results in the esters not being saponified in the mixture, in particular not even under the influence of the high temperatures in steps b) and c). The moderate addition of water also contributes to this. Adjusting the mixture to a water content in the range of 2% by wt. to 20% by wt. in step b) significantly reduces the possibility of hydrolysis of the esters. Selecting the lowest possible temperatures, particularly in steps a) and b), also advantageously leads to the esters remaining stable in the mixture. In this way, a mineral oil-free, biodegradable calcium sulfonate grease can be produced in a particularly advantageous manner.

The at least one alkyl group of the mono-, di- or tri-alkylbenzene sulfonic acid may be linear, branched and/or cyclic alkyl groups. In an advantageous embodiment of the invention, it is provided in this case that at least one alkyl group of the mono-, di- or tri-alkylbenzene sulfonic acid is a (C10-C18)-alkyl group.

The ester composition may comprise a synthetic ester and/or a native (organic) ester, for example. Suitable esters are, for example, mono- and dicarboxylic acid esters, polyol esters and complex esters, but also native ester oils such as rapeseed oil, for example. The ester composition in this case may be composed of an ester or a mixture of two or more different esters. The ester composition should preferably have a viscosity in the range of 2 $mm^2/s$ to 1,200 $mm^2/s$, preferably 10 $mm^2/s$ to 500 $mm^2/s$.

An advantageous embodiment of the invention further provides that the mixture in step a) is adjusted to a base number (TBN) in the range of 150 to 550 mg KOH/g, preferably 210 to 450 mg KOH/g or 320 to 420 mg KOH/g, in particular 211 to 399 mg KOH/g. Alternatively, the base number of the mixture in step a) can also be adjusted to a TBN in the range of 200 to 500 mg KOH/g or 300 to 500 mg KOH/g or 400 to 500 mg KOH/g or 150 to 450 mg KOH/g or 250 to 450 mg KOH/g or 350 to 450 mg KOH/g or 200 to 400 mg KOH/g or 300 to 400 mg KOH/g.

A further advantageous embodiment of the invention provides that the mixture in step b) is adjusted to a base number (TBN) in the range of 50 to 450 mg KOH/g, preferably 70 to 350 mg KOH/g or 100 to 250 mg KOH/g, in particular 80 to 220 mg KOH/g. Alternatively, the base number of the mixture in step b) can also be adjusted to a TBN in the range of 100 to 450 mg KOH/g or 200 to 450 mg KOH/g or 300 to 450 mg KOH/g or 350 to 450 mg KOH/g or 50 to 300 mg KOH/g or 100 to 300 mg KOH/g or 200 to 300 mg KOH/g or 150 to 250 mg KOH/g.

A further advantageous embodiment of the invention provides that the mixture in step a) is heated to a temperature in the range of 35° C. to 85° C. or 45° C. to 60° C., in particular 40° C. to 82° C. Alternatively, the mixture in step a) can also be heated to a temperature in the range of 45° C. to 85° C. or 55° C. to 85° C. or 65° C. to 85° C. or 75° C. to 85° C. or 40° C. to 70° C. or 50° C. to 70° C. or 60° C. to 70° C. or 50° C. to 80° C. or 55° C. to 75° C. In a further advantageous embodiment of the invention, it is provided that the mixture in step b) is heated to a temperature in the range of 87° C. to 102° C. or 85° C. to 100° C., in particular 88° C. to 99° C. Alternatively, the mixture in step b) can also be heated to a temperature in the range of 90° C. to 102° C. or 95° C. to 102° C. or 87° C. to 100° C. or 90° C. to 100° C.

A further advantageous embodiment of the invention provides that the mixture in step c) is heated to a temperature in the range of 100° C. to 180° C. or 110° C. to 170° C., in particular 125° C. to 160° C. Alternatively, the mixture in step c) can also be heated to a temperature in the range of 120° C. to 180° C. or 130° C. to 180° C. or 140° C. to 180° C. or 150° C. to 180° C. or 160° C. to 180° C. or 150° C. to 170° C. or 100° C. to 160° C. or 110° C. to 160° C. or 120° C. to 160° C. or 130° C. to 160° C. or 140° C. to 160° C. or 170° C. to 180° C.

An advantageous embodiment of the invention further provides that the water content of the mixture in step b) is adjusted to a content in the range of 5% by wt. to 18% by wt., in particular 7% by wt. to 15% by wt. Alternatively, the water content of the mixture in step b) can also be adjusted to a content in the range of 5 to 15% by wt. or 10 to 15% by wt. or 7 to 18% by wt. or 10 to 18% by wt. or 9 to 13% by wt.

In order to adjust the basicity of the reaction mixture in step b) to a desired TBN, calcium hydroxide and/or at least one mono-, di- or tri-alkylbenzene sulfonic acid, wherein at least one alkyl group is a (C3-C30) alkyl group, and/or at least one ester composition, wherein the ester composition comprises at least one ester, can be admixed to the mixture. In addition, by adding one or more of the aforementioned substances, the conversion from the vaterite form to the calcite form can be positively influenced in relation to the completeness of the conversion.

In order to further improve the properties of the lubricant according to the invention, additional auxiliary materials and/or additives can be admixed to the reaction mixture. For example, acetic acid can added, preferably in step b), in order to adjust the desired basicity, where appropriate, and achieve an increase in the dropping point due to the resulting calcium acetate. Furthermore, preferably following the conversion into the calcite form, 12-hydroxystearic acid can be admixed, in order to optimize the lubricant in terms of its hydrophobic properties, i.e. its ability to resist water. So that the anti-corrosion protection of the lubricant can be further improved, phenolic antioxidants (e.g. Irganox® L 107, BASF), aminic antioxidants (e.g. Irganox® L 57, BASF) and/or dimercaptothiadiazole derivatives (ADDITIN® RC 8213 (Lanxess)) can be added. All customary additives which improve the consistency and properties of the lubricant according to the invention can be added in principle.

The invention further relates to a lubricant which has been produced by means of the method according to the invention described above. The lubricant according to the invention does not contain any mineral oil and is therefore readily biodegradable according to the requirements of the OECD-301 test method. In addition, unlike mineral oil-containing lubricating greases, it is still flowable, even at very low temperatures (−10° C. to −20° C.), and furthermore has a higher pressure-absorption capacity.

The problem is furthermore solved by a mineral oil-free lubricant which comprises at least one ester composition comprising at least one ester, calcium carbonate and at least one overbased mono-, di- or tri-alkylbenzene sulfonate, wherein at least one alkyl group of the mono-, di- or tri-alkylbenzene sulfonate is a (C3-C30) alkyl group. The lubricant according to the invention is mineral oil-free and contains exclusively esters as the oil component, so that it is readily biodegradable in accordance with the requirements of the OECD-301 test method. Since only esters are contained as the oil constituent rather than mineral oil, the lubricant according to the invention is still flowable, even at very low temperatures, (−10° C. to −20° C.) and also has a very high pressure-absorption capacity.

The at least one alkyl group of the mono-, di- or tri-alkylbenzene sulfonate may be linear, branched and/or cyclic alkyl groups. In an advantageous embodiment of the invention, it is provided in this case that at least one alkyl group of the mono-, di- or tri-alkylbenzene sulfonate is a (C10-C18) alkyl group.

The ester composition may comprise a synthetic ester and/or a native (organic) ester, for example. Examples of suitable esters are mono- and dicarboxylic acid esters, polyol esters and complex esters, but also native ester oils such as rapeseed oil, for example. The ester composition in this case may be composed of an ester or a mixture of two or more different esters. The ester composition should preferably have a viscosity in the range of 2 $mm^2/s$ to 1200 $mm^2/s$, preferably 10 $mm^2/s$ to 500 $mm^2/s$.

It is provided in an advantageous embodiment of the invention that the mineral oil-free lubricant comprises 30% by wt. to 80% by wt. of the ester composition, 5% by wt. to 20% by wt. calcium carbonate and 5% by wt. to 25% by wt. of the overbased mono-, di- or tri-alkylbenzene sulfonate.

A particularly advantageous embodiment of the invention provides that the mineral oil-free lubricant comprises 50% by wt. to 65% by wt. of the ester composition, 10% by wt. to 15% by wt. calcium carbonate and 12% by wt. to 20% by wt. of overbased mono-, di- or tri-alkylbenzene sulfonate.

The lubricant according to the invention may, in addition, comprise an additive. Examples of additives which may be contained are phenolic antioxidants (e.g. Irganox® L 107, BASF), aminic antioxidants (e.g. Irganox® L 57, BASF) and/or dimercaptothiadiazole derivatives (ADDITIN® RC 8213 (Lanxess)).

An exemplary composition of an advantageous embodiment of the lubricant according to the invention is specified in Table 1.

TABLE 1

| Constituents: | Typical percentage fraction: |
|---|---|
| Synthetic ester | 60 |
| Alkyl(C10-C18)benzene sulfonate, calcium salt | 16 |
| Calcium-12-hydroxystearate | 9 |
| Calcium acetate | 1 |
| Calcium carbonate | 12 |
| Irganox ® L 57 | 0.5 |
| Irganox ® L 107 | 0.5 |
| ADDITIN ® RC 8213 | 1 |

Further advantages and features of the invention emerge from the figures and the following examples which show the exemplary and preferred embodiments of the invention.

DESCRIPTION OF EXEMPLARY AND PREFERRED EMBODIMENTS OF THE INVENTION

Figure 1:
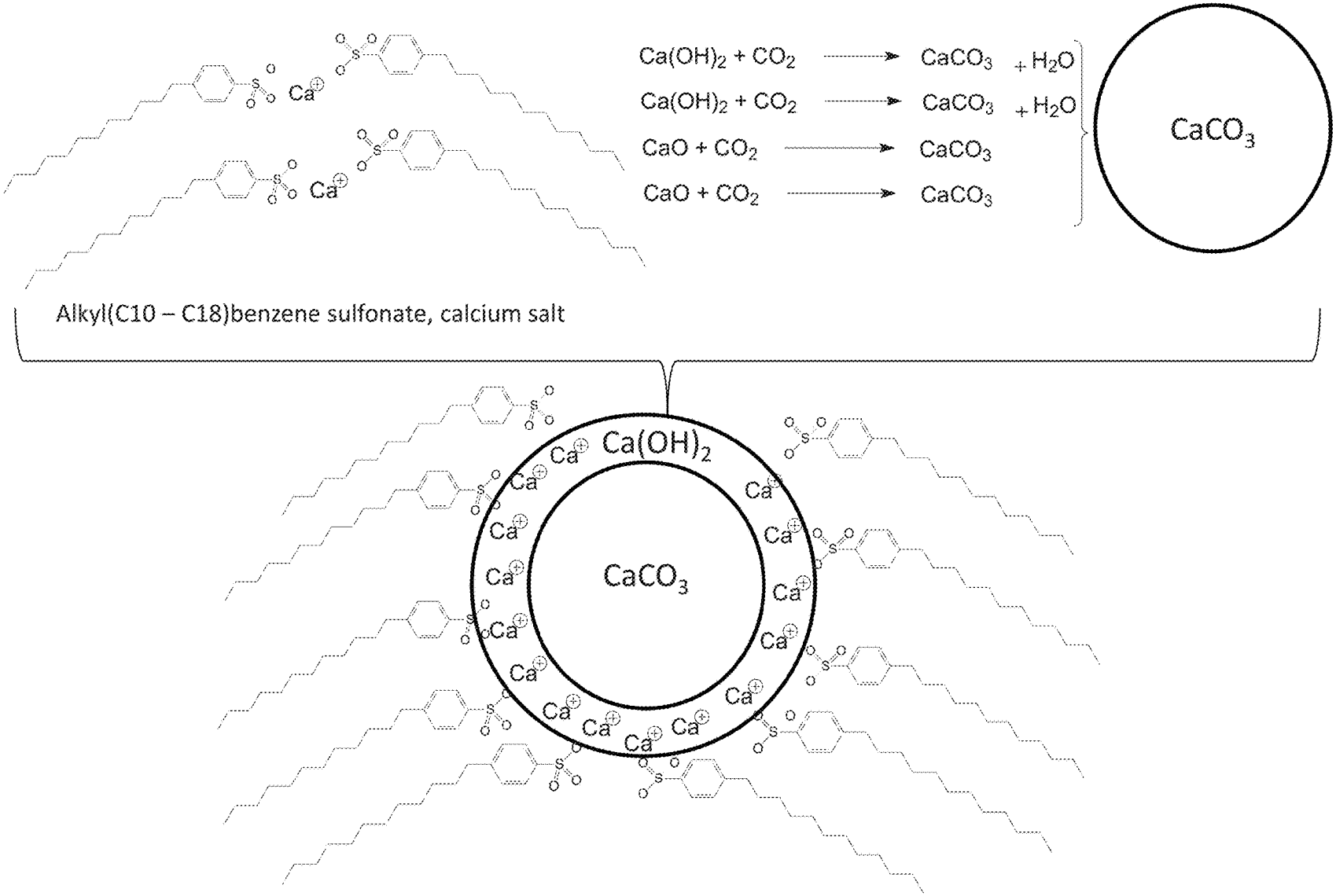
FIG. 1 shows the creation of overbased calcium sulfonate, wherein calcium carbonate micelles are initially formed from calcium hydroxide, calcium oxide and $CO_2$, to which alkylbenzene sulfonates with their polar groups are then attached. The non-polar (lipophilic) alkyl residues in this case are directed outwards and therefore surround the $CaCO_3$ micelles, so that they can be completely dispersed in a base oil (ester composition).

The following examples represent exemplary embodiments of the method according to the invention, wherein the features described or shown here can represent a subject matter of the invention either individually or in any combination, insofar as nothing which is clearly to the contrary emerges from the context of the above description.

Example 1

284 g benzene sulfonic acid C10-18-alkyl-derivative are dissolved in 500 g bis (2-ethylhexyl) sebacate (V40: 10 mm2/s). 10 g calcium hydroxide are then added and the mixture is agitated for 30 mins at 50° C. 133 g calcium oxide and 115 g $Ca(OH)_2$ are then added and the mixture is homogenized by further agitation. The temperature is then increased to 60° C. 110 ml water are then added and carbon dioxide is passed through the mixture. The mixture now has a TBN of 367 mg KOH/g. 300 g bis (2-ethylhexyl) sebacate, 200 g benzene sulfonic acid C10-18-alkyl derivative and 120 g water are then added to the formulation. The formulation is heated to 99° C. Following conversion of the calcium carbonate from the vaterite into the calcite form, the formulation is dewatered at 110° C. The TBN is now around 162 mg KOH/g. The formulation is then heated to 160° C. and kept at this temperature for an hour. After cooling, the grease has a consistency (in accordance with ASTM D217) of 331 mm/10 after 60 double strokes. Further technical data can be obtained from Table 2.

Example 2

280 g benzene sulfonic acid C10-14-alkyl derivative are dissolved in 700 g of a complex ester (fatty acids, C18-unsaturated, dimerized, polymer with 2-ethylhexanol and neopentyl glycol) (V40: 110.5 mm2/s). 11 g calcium hydroxide are then added and agitated for 45 minutes at 50° C. 151 g calcium oxide and 151 g $Ca(OH)_2$ are then added and the mixture is homogenized by agitation. The temperature is then increased to 82° C. 130 g water are then added and carbon dioxide is passed through the mixture. The mixture now has a TBN of 399 mg KOH/g. 300 g complex esters (fatty acids, C18-unsaturated, dimerized, polymer with 2-ethylhexanol and Neopentyl glycol), 220 g benzene sulfonic acid C10-14-alkyl, 21 g acetic acid, 72 g $Ca(OH)_2$ and 180 g water are added to the formulation. The formulation is heated to 92° C. Following conversion of the calcium carbonate from the vaterite form into the calcite form, the formulation is dewatered at 110° C. The TBN is now around 220 mg KOH/g. The formulation is then heated to 160° C. and kept at this temperature for an hour. After cooling, the grease has a consistency (in accordance with ASTM D217) of 292 mm/10 after 60 double strokes. Further technical data can be obtained from the Table 2.

Example 3

280 g benzene sulfonic acid C10-14-alkyl derivative are dissolved in 500 g neopentyl glycol diisostearate (saturated ester) (V40: 48 $mm^2/s$). 11 g calcium hydroxide are subsequently added and agitated for 45 minutes at 50° C. 151 g calcium oxide and 131 g $Ca(OH)_2$ are then added and the mixture is homogenized through further agitation. The temperature is subsequently increased to 62° C. 130 ml water are then added and carbon dioxide is passed through the mixture. The mixture now has a TBN of 369 mg KOH/g. 300 g neopentyl glycol diisostearate (saturated ester, 243 g benzene sulfonic acid C10-14-alkyl, 21 g acetic acid, 72 g $Ca(OH)_2$ and 65 g water are then added to the formulation. The formulation is heated to 92° C. Following conversion of the calcium carbonate from the vaterite form into the calcite form, the formulation is dewatered at 110° C. The TBN is now around 188 mg KOH/g. The formulation is subsequently heated to 160° C. and kept at this temperature for an hour. After cooling, the grease has a consistency (in accordance with ASTM D217) of 272 mm/10 after 60 double strokes. Further technical data can be obtained from the Table 2.

Example 4

Figure 2:
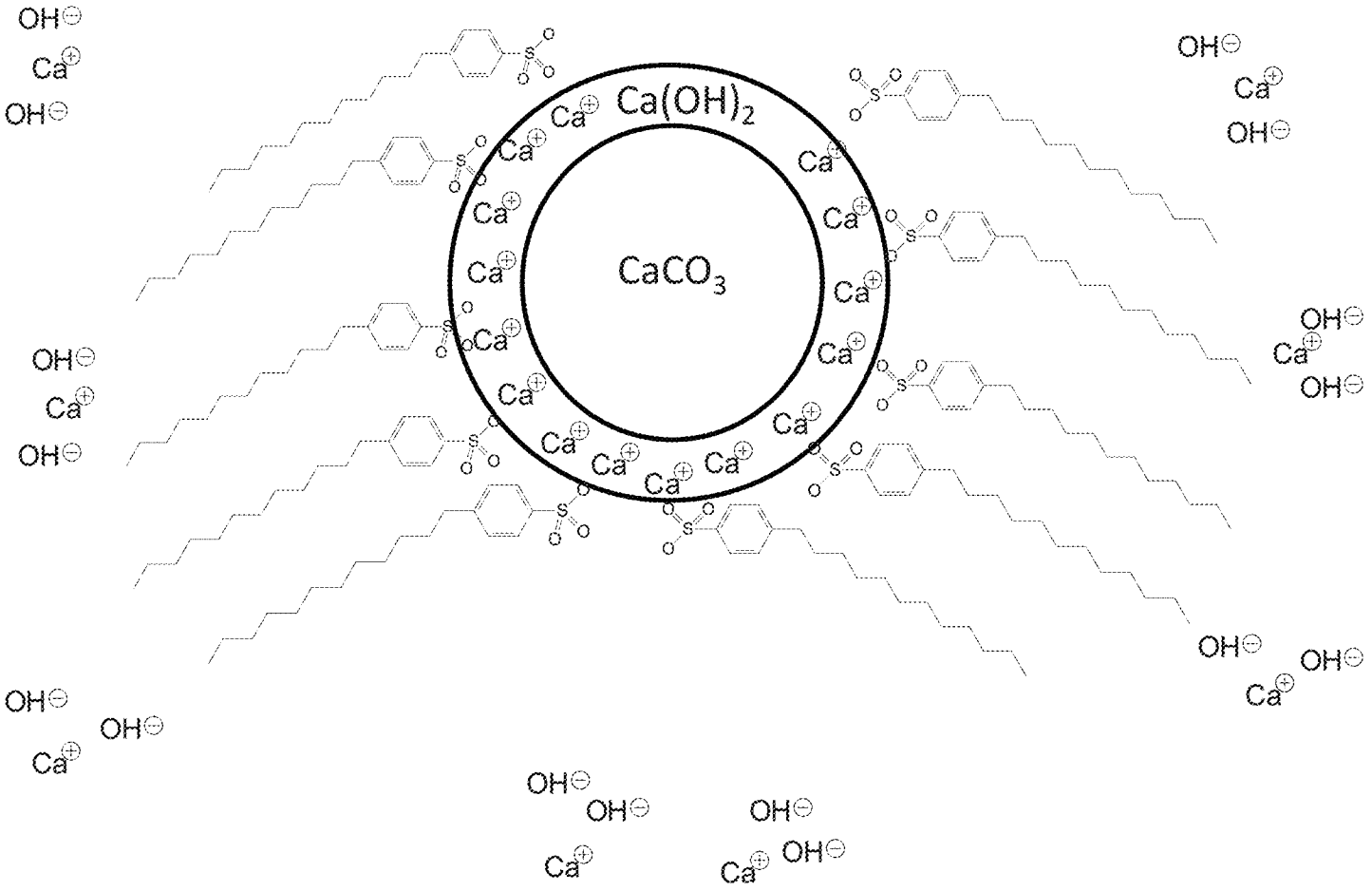
FIG. 2 shows the structure of overbased calcium sulfonate following the addition of $Ca(OH)_2$.
Figure 3:
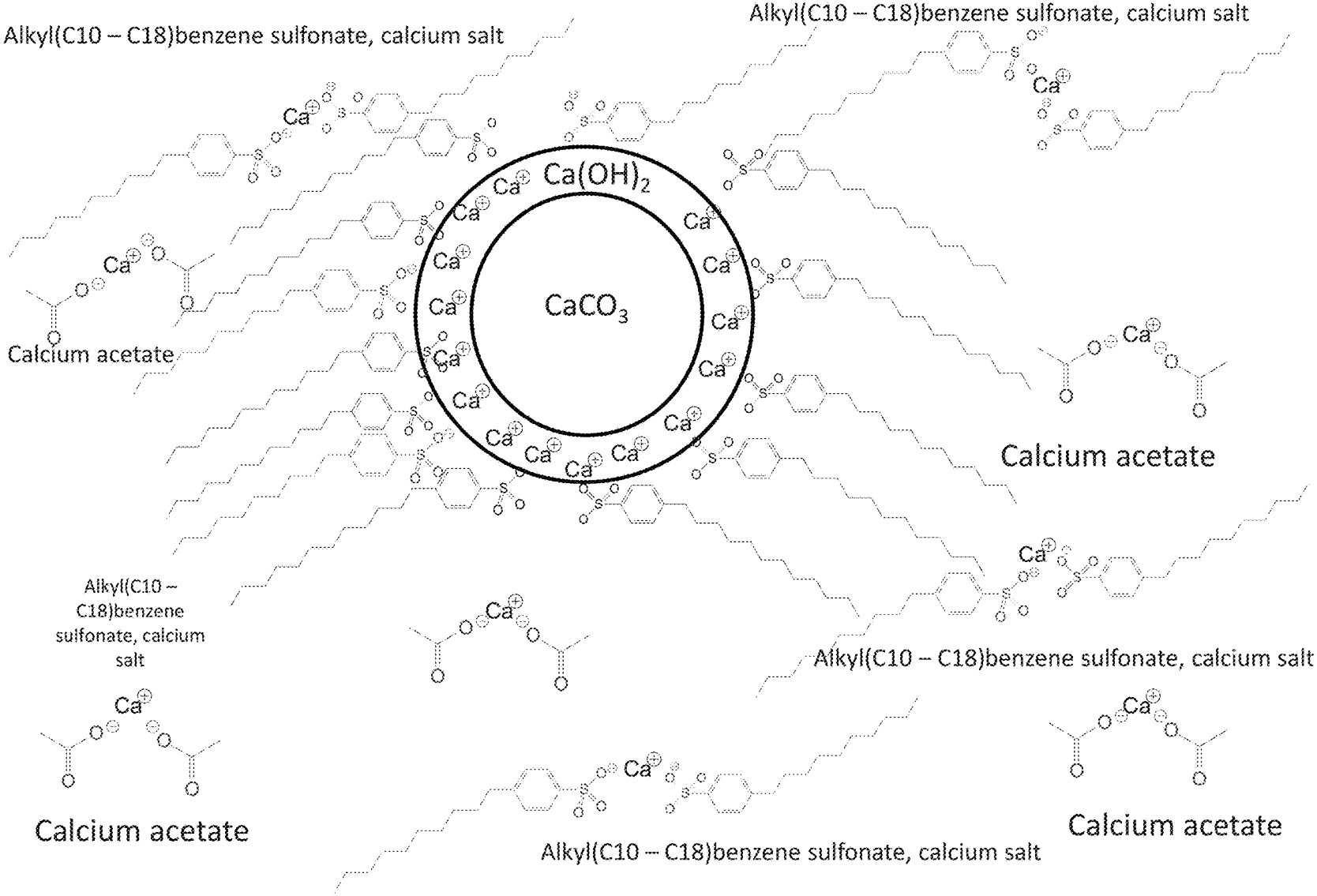
FIG. 3 shows the structure of a mixture of overbased calcium sulfonate, $Ca(OH)_2$, benzoic sulfonic acid (di- or mono-alkyl, C10-C18) and acetic acid.

260 g benzene sulfonic acid C10-18-alkyl are dissolved in 1000 g complex ester (pentaerythritol sebacic acid isostearic acid copolymer) (V40: 1200 $mm^2/s$). 9 g calcium hydroxide are then added and agitated for 30 min at 50° C. 101 g calcium oxide and 104 g $Ca(OH)_2$ are then added and the mixture is homogenized through further agitation. The temperature is subsequently increased to 60° C. 130 ml water are then added and carbon dioxide is passed through the mixture. The mixture has a TBN of 335 mg KOH/g. 400 g bis (2-ethylhexyl) sebacate (V40: 12.5 mm2/s), 270 g benzene sulfonic acid C10-14-alkyl, 75 g $Ca(OH)_2$ and 195 g water are then added to the formulation. The formulation is heated to 92° C. Following conversion of the calcium carbonate from the vaterite form into the calcite form, 150 g 12-hydroxystearic acid are added and the formulation is dewatered at 110° C. The TBN is then around 159 mg KOH/g. The formulation is subsequently heated to 160° C. and kept at this temperature for an hour. After cooling, the grease has a consistence (in accordance with ASTM D217) of 261 mm/10 after 60 double strokes. Further technical data can be obtained from FIG. 2.

Example 5

300 g benzene sulfonic acid C10-18-alkyl are dissolved in 550 g trimethylolpropane trioleate (V40: 46 $mm^2/s$). 120 g calcium oxide and 100 g $Ca(OH)_2$ are then added and the mixture is homogenized through further agitation. The temperature is subsequently increased to 60° C. 80 ml water are then added and carbon dioxide is passed through the mixture. The mixture now has a TBN of 297 mg KOH/g. 280 g trimethylolpropane trioleate, 280 g benzene sulfonic acid C10-14-alkyl, 72 g $Ca(OH)_2$ and 75 g water are subsequently added to the formulation. The formulation is heated to 92° C. Following conversion of the calcium carbonate from the vaterite form into the calcite form, the formulation is dewatered at 110° C. The TBN is around 180 mg KOH/g. The formulation is subsequently heated to 150° C. and is kept at this temperature for half an hour. After cooling, the grease has a consistency (in accordance with ASTM D217) of 299 mm/10 after 60 double strokes. Further technical data can be obtained from Table 2.

Example 6

310 g benzene sulfonic acid C8-C22-alkyl are dissolved in 550 g trimethylolpropane trioleate (V40: 46 $mm^2/s$). 120 g calcium oxide and 100 g $Ca(OH)_2$ are then added and the mixture is homogenized through further agitation. The temperature is subsequently increased to 60° C. 80 ml water are then added and carbon dioxide is passed through the mixture. The mixture now has a TBN of 297 mg KOH/g. 280 g trimethylolpropane trioleate, 254 g benzene sulfonic acid C8-C22-alkyl, 75 g $Ca(OH)_2$, 25 g acetic acid and 70 g water are subsequently added to the formulation. The formulation is heated to 92° C. Following conversion of the calcium carbonate from the vaterite form into the calcite form, the formulation is dewatered at 110° C. and 100 g caproic acid are added. The TBN is now around 161 mg KOH/g. The formulation is subsequently heated to 150° C. and kept at this temperature for half an hour. After cooling, the grease has a consistency (in accordance with ASTM D217) of 287 mm/10 after 60 double strokes. Further technical data are obtained from the Table 2.

Example 7

322 g benzene sulfonic acid C10-18-alkyl are dissolved in 600 g rapeseed oil (V40: 35 $mm^2/s$). 140 g calcium oxide and 80 g $Ca(OH)_2$ are then added and the mixture is homogenized by further agitation. The temperature is subsequently increased to 40° C. 62 ml water are then added and carbon dioxide is passed through the mixture. The mixture now has a TBN of 211 mg KOH/g. 240 g rapeseed oil (V40: 35 mm2/s), 288 g benzene sulfonic acid C10-14-alkyl, 24 g acetic acid, 70 g $Ca(OH)_2$ and 49 g water are subsequently added to the formulation. The formulation is heated to 88° C. Following conversion of the calcium carbonate from the vaterite form into the calcite form, 167 g 12-hydroxystearic acid are added and the formulation is dewatered at 110° C. The TBN is then around 80 mg KOH/g. The formulation is subsequently heated to 125° C. and kept at this temperature for 15 minutes. After cooling, the grease has a consistency (in accordance with ASTM D217) of 299 mm/10 after 60 double strokes. Further technical data can be obtained from Table 2.

TABLE 2

| | Penetration depth (ASTM D217) [mm/10] | Dropping point (IP 396) [° C.] | Resistance to spray water (ASTM D 4049) [%] |
|---|---|---|---|
| Example 1 | 331 | 222 | 97 |
| Example 2 | 292 | 299 | 81 |
| Example 3 | 272 | 280 | 87 |
| Example 4 | 261 | 244 | 52 |
| Example 5 | 299 | 224 | 93 |
| Example 6 | 287 | 287 | 81 |
| Example 7 | 299 | 288 | 78 |

The invention claimed is:

1. A biodegradable, mineral oil-free grease comprising: at least one ester composition comprising at least one ester and being free of any mineral oil, calcium carbonate and at least one overbased mono-, di- or tri-alkylbenzene sulfonate, wherein at least one alkyl group of the mono-, di- or tri-alkylbenzene sulfonate is a (C3-C30) alkyl group, and wherein said calcium carbonate is surrounded by said mono-, di- or tri-alkylbenzene sulfonate.

2. The grease according to claim 1, wherein the grease comprises 30% by wt. to 80% by wt. of the ester composition, 5% by wt. to 20% by wt. calcium carbonate and 5% by wt. to 25% by wt. of the overbased mono-, di- or tri-alkylbenzene sulfonate.

3. The grease according to claim 1, wherein the grease comprises 50% by wt. to 65% by wt. of the ester composition, 10% by wt. to 15% by wt. calcium carbonate and 12% by wt. to 20% by wt. of overbased mono-, di- or tri-alkylbenzene sulfonate.

* * * * *